United States Patent [19]

Otters

[11] Patent Number: 4,723,410

[45] **Date of Patent: * Feb. 9, 1988**

[54] SAFETY IMPROVEMENTS IN HIGH PRESSURE THERMAL MACHINES

[76] Inventor: John L. Otters, 11317 Miller Rd., Whittier, Calif. 90604

[ * ] Notice: The portion of the term of this patent subsequent to Jan. 27, 1987 has been disclaimed.

[21] Appl. No.: 917,422

[22] Filed: Oct. 10, 1986

Related U.S. Application Data

[63] Continuation-in-part of Ser. No. 790,039, Oct. 22, 1985, Pat. No. 4,638,633.

[51] Int. Cl.[4] ..... F02G 1/04

[52] U.S. Cl. ..... 60/518; 60/517; 60/520; 60/525

[58] Field of Search ..... 60/517, 518, 520, 525

[56] References Cited

U.S. PATENT DOCUMENTS 4,638,633 1/1987 Otters ..... 60/520 X

*Primary Examiner*—Allen M. Ostrager

*Attorney, Agent, or Firm*—William H. Pavitt; Nathan Epstein

[57] ABSTRACT

In a stirling cycle machine a shell means enclosing the machine body for maintaining a substantially sealed atmosphere about the machine body. A diffuser arranged between the machine body and the outer shell for diffusing a shock wave traveling towards the outer shell as the result of an explosive failure of the machine body.

32 Claims, 21 Drawing Figures

SAFETY IMPROVEMENTS IN HIGH PRESSURE THERMAL MACHINES

CROSS REFERENCE TO RELATED APPLICATION

This application is a continuation-in-part of serial number 06/790,039, filed Oct. 22, 1985, now U.S. Pat. No. 4,638,633.

BACKGROUND OF THE INVENTION

1. Field of the Invention

The present invention relates generally to the field of Stirling or similar cycle thermal machines and is more particularly directed to a thermal machine sealed within an outer shell enclosure which maintains the engine components in an axially compressed state to thereby simplify construction of the engine while maintaining a sealed atmosphere of working fluid about the engine thereby minimizing leakage seal problems and also providing a containment enclosure about the engine in the event of explosive failure of the same.

2. State of the Prior Art

The present invention is generally directed to thermal machines of the general type wherein a working fluid is subjected to a thermodynamic cycle within a chamber by reciprocating a displacer body within the chamber for displacing the working fluid between a hot and a cold space in the chamber. In the case of an engine a heat input is provided and the resulting cyclic variations in working fluid pressure may drive a work piston so as to derive a work output. Conversely, a work input may reciprocate a compressor piston so as to alternately compress and expand the working fluid. The resulting cyclic variations in working fluid temperature are used in a refrigerator for cooling one end of the working fluid chamber in a manner well known in the art.

In either case, the working fluid is usually contained at a relatively high pressure and presents problems in terms of leakage both around the work piston through the dynamic seal between such piston and its cylinder wall, and also through various joints and connections in the machine housing to the outer atmosphere. The control of such leaks, particularly in cases where the working fluid is flammable, such as hydrogen, has been a source of continuing difficulty to which many solutions have been proposed.

The thermodynamic efficiency of such thermal machines is dependent in part on the mean pressure of the working gas and on the temperature differential between the hot and cold spaces of the displacer chamber. In an engine, greater efficiency can be obtained by supercharging the displacer chamber with working gas at very high pressures and then operating the engine at the greatest possible temperature differential between the hot and cold ends of the displacer chamber, thus heating the already highly pressurized working gas to very high temperatures. In practice however, the maximum safe operating pressures and temperatures of Stirling and similar engines are limited by the physical properties of the materials used in constructing the engine and on the construction and assembly techniques used.

Stirling cycle and similar machines are often designed along a main axis extending between a thermal end which receives the heat input and opposite work end at which work is either delivered in an engine or applied in the case of a refrigerator. Temperatures of engine components vary greatly at different points along this main axis, typically reaching extremes at the thermal end and graduating to near ambient temperature at the work end.

The bodies or housings of such machines are typically assembled in several axial body sections which are secured to one another by means of radial flanges on each body section. The flanges are bolted, screwed or clamped together to hold the various sections against the internal operating pressures of the machine and in combination with sealing rings or gaskets to make high pressure gas tight seals where needed to contain any pressurized fluids within the machine. Greater working fluid pressure require increasingly heavy cylinder walls at the same time that the strength of the engine body material is degraded as operating temperatures are increased. Metal alloys conventionally used in making machine body sections thus set upper limits to the working fluid pressures and temperatures which fall short of the operating parameters desirable for optimum machine efficiency.

Recent advances in material technology have produced new categories of materials, particularly ceramics, capable of withstanding substantially higher temperatures and pressures than metallic alloys normally used for engine components. While it would be advantageous to incorporate ceramic parts into thermal machines and particularly into external combustion engines in cases where operating temperatures exceed 1,100 degrees Centigrade (approximately 2,000 F.), difficulties exist in assembling a hybrid engine comprising both ceramic and metallic parts due to their dissimilar mechanical characteristics, particularly their varying coefficients of thermal expansion. In external combustion engines for example, it has been found advantageous to use ceramic material such as silicon carbide for the engine heater head while retaining metallic materials for the cooler sections of the engine. Ceramic materials while able to withstand substantial pressures, are more brittle than metallic components and thus do not flex readily under the compound stresses frequently imposed by fasteners, e.g. bolts, tie-rods, etc., normally used to assemble the axial sections comprising the machine body. The use of brittle materials for the heater head is complicated not only by the different mechanical properties at high temperatures, but also because the ceramic material is limited in the amount of working fluid pressure which it will safely tolerate due to its brittleness, particularly at high temperatures. Further, the physical properties of ceramic materials are less uniform and predictable than those of metallic alloys and the use of ceramics therefore calls for higher design safety margins. Even where the machine body sections are made of similar materials, e.g. all steel bodies, conventional assembly techniques call for relatively massive radial flanges on each body section which are bolted or clamped together. As operating pressures and temperatures are increased these flanges as well as the cylinder walls of the machine body must be made increasingly heavy, practical considerations ultimately limiting the maximum safe operating pressures and temperatures.

Another problem area in Stirling cycle machines has been adequate control over leakage of the pressurized working fluid. The working fluid is contained in a displacer chamber where it is subjected to a thermodynamic cycle with consequent expansion and contraction of the working fluid. The cyclical variations in working fluid pressure drive a work piston from which a work output is derived. In many previous engine designs, fluid leakage around the work piston has been a continuing source of difficulty, both in terms of contamination of the working fluid by extraneous fluids (e.g. hydraulic fluid pumped by the work piston) and also loss of pressurized working fluid through leakage around the work piston. One solution to this problem has been proposed by this applicant in U.S. Pat. No. 4,489,554, consisting of a compound work piston where two piston elements are connected by an axial, small diameter linkage which is easier to seal than the larger diameter piston and which may also form part of a pumping arrangement designed to recover leaking working fluid, either by returning the same to the displacer chamber or by feeding it to the engine burner for combustion.

Further improvement of Stirling cycle and similar machines is needed to overcome the aforementioned difficulties.

SUMMARY OF THE INVENTION

The present invention seeks to overcome these and other shortcomings of the prior art by providing a hermetically sealed outer shell or vessel fully enclosing the thermal machine, which may be configured as either an engine or refrigerator.

The outer shell may be tubular and closed at two opposite shell ends, the central longitudinal axis of the shell being aligned with the axis of the thermal machine such that the two axial ends of the machine body are maintained in compression between the two shell ends. The outer shell is dimensioned and constructed for maintaining the thermal machine body in a normal state of axial compression along the main longitudinal axis of the machine body in cooperation with a pre-loading device. Thus a machine body consisting of several distinct axial elements or sections can be held together axially by nothing more than the compressive force exerted thereon, advantageously replacing the flange-and-fastener approach presently required to interconnect the various axial components of such a machine body. The outer shell is maintained in a normal state of tension relative to the machine body either by one or more pre-loading devices axially interposed in compression between the machine body and the outer shell, thereby maintaining the machine body in axial compression. In the alternative the outer shell may be appropriately undersized axially relative to the machine body so as to stretch the shell axially between the machine body ends. The tensile force on the outer shell is desirably transmitted through a spherical aligner interposed between the shell and the machine body at each end of the shell so as to compensate for possible deviations in tha axial alignment of the machine body sections thereby to maintain the outer shell in pure axial tension notwithstanding inaccuracies in the axial alignment of the machine body sections.

The present invention eliminates the use of fasteners particularly for axially interconnecting machine body sections of dissimilar or similar materials, as for example attaching a ceramic hot head to metallic machine body portions. At the same time, the resistance of the ceramic elements to high internal pressure at temperature extremes is increased by maintaining the ceramic material in axial compression without being subjected to the compound stresses which would be imposed on the ceramic sections if conventional flanges and fasteners were used.

Bolted flanges have a tendency to exert compound stresses on the machine body components which are poorly tolerated by ceramic or similarly brittle material. The use of an outer shell makes possible the application of axial or column loading on the various machine body sections so as to form high pressure seals between the machine body sections regardless of similarity of material. For example, a brittle ceramic hot end of an engine can be axially compressed against axially adjacent body sections to maintain the high pressure seal necessary to contain highly pressurized working fluid and in fact thereby increasing the brittle ceramic material's resistance to high internal engine pressure.

The outer shell is further useful as a containment vessel and physical shield for protection against possible explosive failure of a machine operated at pressure and temperature limits in excess of those considered safe in current machine designs. By dimensioning the outer shell so that its inner volume is substantially greater than the volume occupied therein by the machine body, a buffer space may be defined between the outer shell and the machine body which desirably is substantially greater than the volume of compressed working fluid contained in the machine body so as to allow decompression of pressurized gases released into the buffer space upon explosive failure of the machine body to a pressure level which can be contained by the shell wall.

The outer shell of this invention facilitates use of ceramic body elements thus allowing operation of the machine along a thermodynamic cycle extending between greater temperature extremes, while the containment and shielding functions of the outer shell permit increased operating pressures, thereby improving thermodynamic cycle efficiency.

Still further, the outer shell permits the operation of the thermal machine in a closed atmosphere of working fluid, whereby a common gas is maintained throughout the system, both inside and outside the body of the thermal machine, thus greatly alleviating the problem of leakage of working gas to the atmosphere or contamination of the working fluid with air. The requirements imposed on the gas seals internal to the machine body are greatly reduced since a moderate amount of working fluid leakage from the machine into the surrounding buffer space defined by the outer shell may be tolerated and the leaking fluid returned to the machine or a storage container by means of suitable pumps, or in the alternative may be disposed of by combustion in an engine burner. The working gas atmosphere in the buffer space contained by the outer shell is preferably maintained at only slightly above atmospheric pressure to minimize the sealing requirements between the shell and the outer environment, particularly for mechanical shafts passing through the outer shell wall and also to prevent flow of air into the shell through such sealed shaft openings.

As will be apparent from the various examples in the following detailed description, the multiple benefits derived from use of an outer shell or containment vessel according to this invention facilitate and simplify the design and construction of the thermal machine while at the same time permitting the use of materials for machine body components having advantageous properties but which have been found difficult to assemble into conventional thermal machine construction, minimizes working fluid sealing problems, and provides a safety shield which allows operation of the machine at higher pressures and temperatures for improved thermodynamic efficiency.

This applicant is not aware of existing thermal machine designs which include an outer shell for the purposes described herein, and in particular does not believe it known to provide such an enclosure with spherical aligners at each end for maintaining the shell in axially aligned tension.

Various additional improvements are disclosed which enhance the containment capabilites of the outer shell envelope to thereby increase the safety of operation of the thermal machine at high operating cycle temperatures and pressures. Specifically, a shock wave diffuser element or matrix is provided surrounding the thermal machine body within the buffer space defined by the outer shell for diffusing and dispersing the pressure wave resulting in the event of explosive failure of the machine body with consequent sudden release of highly pressurized gas and solid fragments projected against the outer shell. Various possible embodiments of such diffusion element are described.

The use of Delta rings interposed between adjacent axial body sections of the thermal machine is described for maintaining a pressure seal between body sections while at the same time maintaining radial alignment of the body sections.

Rupturable elements such as burst discs may be provided in a bulkhead transversely partitioning the outer shell into two or more compartments, which yield at an excessive pressure differential across the bulkhead to admit gas expansion into the lower pressure compartment and thus relieve pressure on the outer shell in the event high pressure gas is released from the machine body into the outer shell. The bulkhead may be allowed axial displacement relative to the outer shell to accommodate thermal expansion by providing a dynamic seal between the bulhead and the outer shell.

An alternate machine body pre-loading system is disclosed employing an open structure of tie-rods connecting two end pieces acting on the opposite ends of the machine body, without a closed outer shell envelope.

A normally open anti-detonation valve may be provided in the outer shell which closes in response to a sudden internal rise in shell pressure so as to prevent release of potentially flammable or otherwise dangerous gases into the atmosphere. The normally open valve may include igniter means for igniting flammable working gas leaking from the shell interior through the normally open valve, and flame arrestor means to prevent flaming gas from flowing out of the shell.

These and other advantages of the present invention will be better understood by reference to the accompanying drawings taken in light of the following detailed description of the preferred embodiments.

DETAILED DESCRIPTION OF THE PREFERRED EMBODIMENTS

Figure 1:
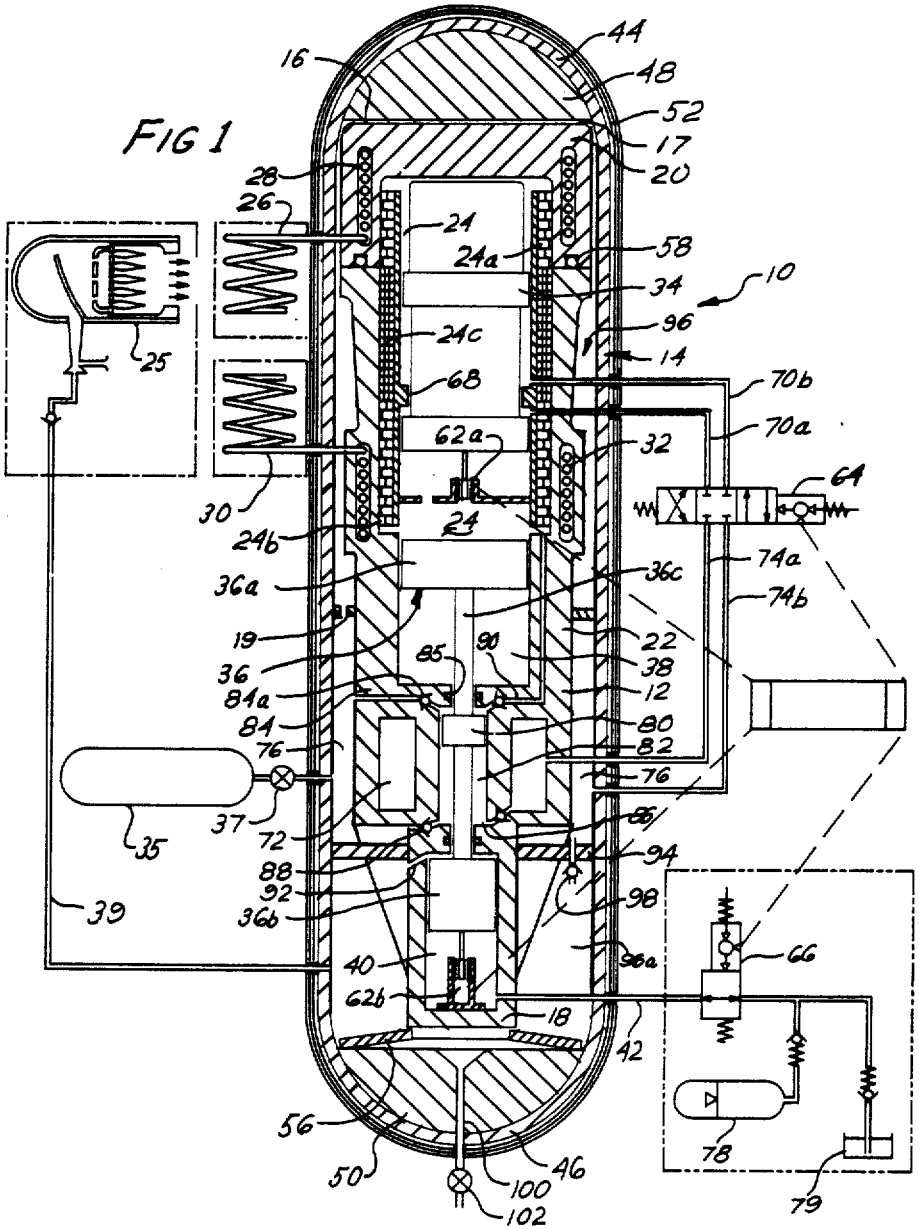
FIG. 1 is a longitudinal section of a Stirling engine constructed according to this invention characterized by a heat source external to the outer shell and a hydraulic output.

With reference to the drawings, FIG. 1 shows an improved thermal machine 10 comprising a Stirling cycle engine 12 enclosed within an outer shell 14. The engine 12 is arranged along a main engine axis extending between a hot thermal end 16 and an opposite work output end 18. The body of engine 12 comprises a heater head section 20 made of a ceramic such as Silicon Carbide and a metallic body section 22 constituting the remainder of the engine body. A displacer chamber 24 is partly defined by the ceramic head 20 and partly by the metallic portion 22 and is filled with a suitable working fluid such as hydrogen or helium gas. The hot and cold spaces of the displacer chamber 24 are provided with heat exchangers 24*a* and 24*b* respectively and a regenerator 25 connecting the hot and cold ends of said chamber. The heater head 20 is heated as by sodium vapor supplied by heat pipe 26 to engine heater coil 28. The heat input to the engine 12 is provided by a gas burner 25 external to the outer shell 14. The cold end of the displacer chamber 24 is cooled by a suitable fluid such as ammonia supplied to cooling coil 32 by heat pipe 30. The working fluid within the displacer chamber is subjected to a thermodynamic cycle by being displaced between the hot and cold ends of the displacer chamber in response to reciprocating movement of displacer 34. The resulting cyclic variations in working fluid pressure drive a compound work piston 36 against a gas spring 38. In the illustrated embodiment, the compound work piston includes a first piston element 36*a* driven by the working fluid and a second piston element 36*b* connected by a relatively small diameter axial rod or linkage 36*c* to the element 36*a*. The element 36*b* pumps a hydraulic fluid in chamber 40 through an output line 42.

Figure 3:
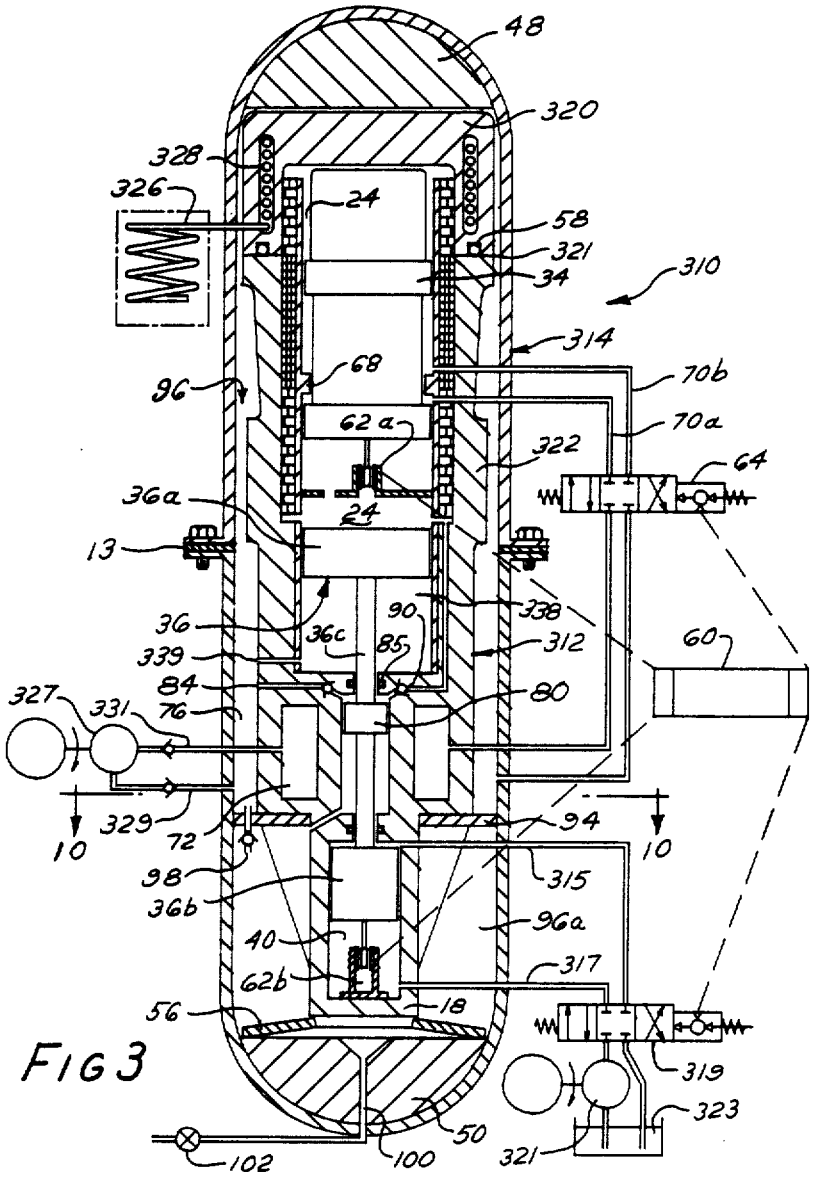
FIG. 3 is a longitudinal section of a Stirling cycle refrigerator according to this invention.

The outer shell 14 is cylindrical in cross-section and is terminated by an upper hemispherical end portion 44 and lower hemispherical end portion 46. The shell may be made in two halves joined at the middle of the shell cylinder as shown in Fig. 3 by means of flanges 13 bolted, screwed or clamped together as in conventional high pressure vessel construction, particularly autoclave vessels. In small units it may be desirable to weld the two shell halves together to make a sealed vessel which can be readily cut open at the weld line if repairs to the machine enclosed therein become necessary. The shell may be made of metal such as high strength steel, high strength aluminum, or mild steel, or in the alternative plastic or composite materials may be used. The shell halves may be made by casting, forging, or deep drawing methods, or may be fabricated from rolled sheet metal welded to pressure formed end caps. The outer shell or envelope 14 may be reinforced by winding a continuous high strength glass or carbon fiber filament either circumferentially, longitudinally or both to make an outer filament layer 52 over the hermetically sealed wall of the shell 14, thereby to put the shell 14 in compression according to the direction of the filament winding.

Interposed between the hemispherical end portions of the outer shell and the corresponding end of the engine body are two spherical aligners 48 and 50. Each aligner is shown as a solid hemispherical body, although it may be partially hollowed out for weight savings, and having a smooth outer spherically curved surface and a plane circular inner surface. The outwardly facing spherical surfaces of the two aligners fit closely within and are slideable against the spherically concave inner end surfaces of the outer shell 14.

The upper spherical aligner 48 has a planar inner face acting against the flat upper end 16 of the ceramic heater head 20 through a zirconia ceramic flat pad insulator 17. The lower end 18 of the engine is supported by a Belleville type pre-loading spring 56 compressed between the engine end 18 and the spherical aligner 50 for compressively loading the engine body assembly between the two spherical aligners 48 and 50. The preloading spring is selected to apply a compressive force to the machine body substantially in excess of the maximum internal operating pressures in the engine body 12 acting to axially separate the body sections 20 and 22 so as to maintain the engine body 12 under axial compression at all times and assure the integrity of the gas seal 58 against internal operating pressures. In the event of axial misalignment of the various engine body sections causing the longitudinal axis of the engine 12 to move out of alignment with the central longitudinal axis of the outer shell 14, one or both of the spherical aligners 48 and 50 are able to rotate against their corresponding spherical end cap 44, 46 so as to maintain alignment of the compressive force along the central axis of the outer shell 14 and prevent imposition of a bending moment on the outer shell resulting from such misalignment. Vertical alignment of the engine body may further be assured against lateral buckling due to the axial loading of the engine body by provision of a transverse support 19 connecting the engine body to the wall of the outer shell at a longitudinally intermediate point thereof. The support is perforated or apertured for allowing free flow of gas therethrough.

This outer shell arrangement maintains the ceramic head 20 in axial compression against the metallic engine block section 22 while the outer shell is in axial tension between the two spherical aligners under the loading of spring 56. A gas tight seal for containing the pressurized working gas in displacer chamber 24 is maintained between the ceramic head 20 and engine block 22 by providing a static seal ring 58 set into a circular groove formed in one or both of the ceramic head 20 and the upper end of the metallic engine block 22. The seal is maintained only by the axial compressive force acting on the engine body sections and no other fastener is used to hold together the engine body sections nor to maintain the seal between the ceramic head and metallic engine block. In certain cases, such as small engine or machine bodies a gas tight seal can be secured by merely lapping flat the mating surfaces of the axially adjacent body sections which are then held tightly against each other by the force of the pre-loading spring 56. It is desirable in any case to provide locating rings (not shown) set in aligned grooves in the mating surfaces or similar means for holding the adjacent engine body sections in radial alignment and against radial shifting relative to each other. It is understood that the engine body and particularly section 22 thereof may consist of a greater number of discrete axial sections held together axially by the force applied by pre-loading spring 56 relative to the tensed outer shell 14.

As the engine is charged with pressurized working fluid following initial assembly, and as the working fluid and engine components are heated during engine operation, misalignments of the axial engine geometry resulting from thermal expansion are accommodated by movement of the spherical aligners.

In a practical engine constructed according to this invention, the body of engine 12 would be surrounded by layers of heat insulating material (not shown in the drawings) and the diameter of the outer shell 14 is desirably sized so as to enclose a volume greater than the volume occupied therein by the actual engine 12. This provides a buffer space 96 sufficient to allow decompression of explosively released working gas to a pressure which can be contained by the wall of the outer shell 14. Thus the shell 14 not only is intended to contain flying fragments resulting from catastrophic failure of the engine, but to also contain explosive release of gas resulting from failure of any part of the engine 12.

The top of the hydraulic fluid chamber 40 is vented to the low pressure buffer space by passage 92 and the buffer space enclosed by the outer shell 14 is divided by a transverse bulkhead 94 into a lower buffer space 96*a* and an upper buffer space 76. The lower space 96*a* is isolated by the bulkhead 94 and a pressure equalizing anti-contamination check valve 98 to prevent contamination of the upper space 76 due to possible out-gassing from the hydraulic fluid in chamber 40 into the lower buffer space. Any leakage of hydraulic fluid through passage 92 from the engine into the lower buffer space 96a is drained through a drain conduit 100 provided with a drain valve 102 and extending through the lower spherical aligner 50 and through a pressure seal in shell 14.

The engine cycle is controlled by means of engine controller 60 which receives input information derived from position sensors such as LVDT position sensors 62a and 62b. The input information is indicative respectively of the position of the displacer 34 and piston 36 along their respective strokes. The engine controller 60 derives an output control signal based on said input information which controls a four-way servo valve 64 and a two-way servo valve 66. The valve 64 pneumatically controls the motion of the displacer 34 by applying a controlled pressure differential across a dynamic seal 68 through pneumatic lines 70a and 70b. The pneumatic displacer drive is supplied with high pressure gas through supply line 74a from an annular gas storage reservoir 72 defined in the engine body section 22 while a pressure sink is obtained through return line 74b connected to the sealed buffer space 96 defined between the outer shell 14 and the engine 12, and which is filled with working gas at atmospheric or preferably somewhat above atmospheric pressure.

The engine controller 60 controls the direction and magnitude of the pressure differential between the pneumatic control lines 70a and 70b through the servo valve 64 to maintain positive control over the motion of displacer 34. The engine controller 60 also controls servo valve 66 which controls the volume of hydraulic fluid flow into and out of piston chamber 40 through conduit 42, i.e. both outflow to hydraulic pressure accumulator 78 and inflow from hydraulic fluid reservoir 79. The motion of the compound work piston 36 is thus likewise under positive control independently of the displacer 34 and therefore the phase relationship between the displacer and compound work piston can be adjusted to obtain a desired engine cycle. For a more detailed description of such an engine control system reference is made to U.S. Pat. No. 4,489,554 issued to this applicant.

In a pneumatic engine control system such as this, it is advantageous to maintain the highest possible working fluid mean pressure in displacer chamber 24 so as to increase the stiffness of the working gas and thereby maintain more accurate control over the displacer. This objective is in accord with the aforementioned desirability of operating such engines at high working fluid pressures for improved thermodynamic efficiency. However, higher working fluid pressures also increase the risk of explosive failure of the engine body, particularly where brittle ceramic components are used. This hazard is safeguarded against by the outer shell 14 which forms both a decompression buffer space 96 and presents a physical barrier against flying fragments. Provision of such buffer space not only eliminates or greatly diminishes the usual problems of sealing two gases against each other, such as highly pressurized hydrogen working gas v. atmospheric air, but also provides a reservoir for containing working gas leaking out of the displacer chamber 24 and which can then be repressurized for use in the pneumatic control system or returned to the displacer chamber 24. This is achieved by an internal gas pump arrangement comprising a gas pump piston 80 affixed on work piston linkage rod 36c of the compound work piston 36 and which reciprocates within a pump chamber 82 sealed at each end by dynamic seals 86. On the down stroke of the work piston 36 gas is drawn from the low pressure buffer space 76 through intake conduit 84 and check valve 84a, while gas present in the pump chamber 82 below piston 80 is pumped through outlet conduit 86 into the high pressure gas storage chamber 72 for use in the pneumatic control system. On the up stroke of the pump piston 80, gas is drawn from the low pressure buffer space 76 through inlet conduit 88 while gas present in the pump chamber 82 above the piston 80 is pumped through outlet conduit 90 into the displacer chamber 24, thereby maintaining working fluid pressure there. A working gas supply tank 35 connected through pressure regulating valve 37 to the upper buffer space 76 provides the working gas necessary to run the entire system, supplying gas as fuel to the engine burner 25 through check valve 98 in the transverse baffle 94 and burner supply line 39 connected to the lower buffer space 96a.

It will be appreciated that provision of the outer shell 14 thus permits operation of the engine 12, including a working gas leakage control system and a pneumatic engine control, as a closed system sealed against loss of working fluid to the outer environment.

Figure 2:
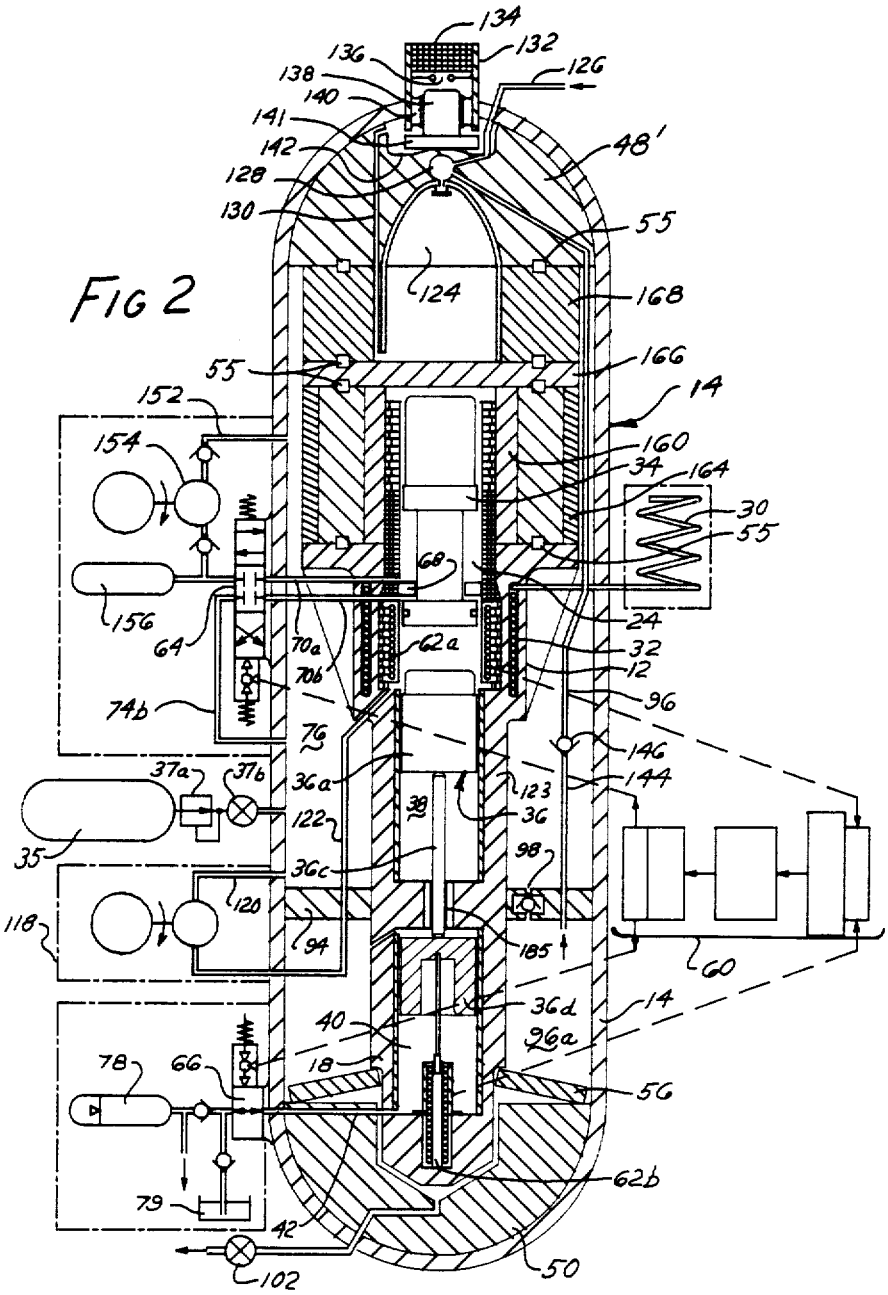
FIG. 2 is a longitudinal section of a second embodiment of the novel Stirling engine powered by a gas burner internal to the engine's outer shell.

The engine of FIG. 2 differs in several respects from the embodiment of FIG. 1, but like elements bear like numbers. A first difference is the use of an external motor driven gas pump 118 for pressurizing working gas drawn from the low pressure upper buffer space through intake conduit 120 and returned to the displacer chamber by way of conduit 122. The motor driven pump 118 replaces the use of the pump piston 80 and associated components in FIG. 1.

Secondly, the FIG. 2 embodiment includes a gas combustor 124 internal to the outer shell 14 which is fed by a gas-air mixture consisting of atmospheric air drawn through intake conduit 126, mixed with combustible gas in mixing chamber 128, and then burned in combustion chamber 124. Exhaust gases produced by combustion are discharged through conduit 130 from the combustion chamber and vented to the atmosphere through an exhaust pipe 132 provided with a flame arrester 134 and leakage gas igniter 136. An anti-detonation valve 138 consists of a slideable plunger provided with a closure element 141 dimensioned to cover and close the vent passages 140, but which is in the normally open position shown in FIG. 2 allowing free out-flow of exhaust gases through the vent pipe 132. In the event that structural failure of the engine 12 or a detonation in the combustor chamber 124 releases pressurized gas into the buffer space, the high pressure front of suddenly released gas operates to push up and close the anti-detonation valve 138 so as to close the vent openings 140 with the enlarged bottom portion of the anti-detonation valve 138.

The gas fuel for the engine combustor 124 may be conveniently drawn from the low pressure lower buffer space 96a itself in those cases where the working fluid is combustible, as for example in the case of hydrogen gas. Thus, working gas lost from the displacer chamber through leakage into the buffer space 76 through any leak path in the engine can be recovered either for return to the displacer chamber and/or for use in fueling the engine combustor 124. In particular, in an engine provided with a transverse bulkhead 94 gas from the upper low pressure buffer chamber 76 may be compressed and returned to the displacer chamber while potentially contaminated gas from the lower low pressure buffer space 96a may be fed to the combustor chamber 124 through a conduit 144 provided with an anti-flashback check valve 146 and connected to mixing chamber 128.

A working gas supply tank 35 similar to that of FIG. 1 is connected through pressure regulator 37a and valve 37b to the upper buffer space 76, and supplies working gas to the engine burner 124 through pressure equalizing valve 98 and lower buffer space 96a, then through combustor supply line 144 connected to mixing chamber 128. The working gas supply tank 35 also feeds the upper buffer space 76 from where working gas is drawn by conduit 152, pressurized by a motor driven pump 154 external to the outer shell 14 and stored in pressure vessel 156 for use in the pneumatic displacer drive and control system which includes four-way pneumatic valve 64 controlled by an output control signal derived by engine controller 60 as has been explained in connection with FIG. 1 for applying a controlled pressure differential across dynamic seal 68 by means of pneumatic lines 70a and 70b. The compound work piston 36 in FIG. 2 lacks the gas pump piston 80 and associated gas pump of FIG. 1 which has been replaced by external gas pump 154 powering the pneumatic displacer control system, and by external gas pump 118 for repressurizing the displacer chamber 24 with working gas drawn from upper buffer space 76 so as to make-up for leakage around the work piston element 36a and high pressure seal 185 or through other leakage paths.

In the engine of FIG. 2, a more complex and realistic hot end insulating assembly is shown consisting of a number of separate insulating elements of ceramic or equivalent material, as for example a cylindrical silicon carbide inner liner 160 surrounded by a high pressure insulating ring 162 of e.g. zirconia ceramic. Both ceramic rings 160 and 162 are held in radial compression by means of an outer compression ring 164 made of,e.g., high strength steel shrink-fit over insulating ring 162. The use of the compression ring 164 places the inner ceramic rings 160 and 162 under both radial as well as axial compression, thereby increasing the upper pressure limit at which the working gas may be safely operated in the displacer chamber 24. The three concentric rings 160, 162 and 164 comprise an engine body section held in axial compression between a transverse heater plate 166 and the upper end of the lower portion 123 of the engine body. The heater plate 166 may be of a heat conducting ceramic material such as silicon carbide formed with finned upper and lower surfaces for optimum heat exchanging characteristics. The upper surface of the plate 166 is heated by the burner 124 and the heat is transferred through the plate to the gas in the upper or hot end of the displacer chamber 24. The burner 124 is surrounded by an insulating ring 168 of a suitable material such as zirconia ceramic. It will be appreciated thus that the body of the engine in FIG. 2 is comprised of a number of axially assembled sections consisting of burner insulating ring 168, heater plate 166, displacer chamber insulation ring assembly including rings 160, 162 and 164, and the lower portion 123 of the engine body which includes the work piston assembly. The several engine body sections are held axially together only by the pre-loading spring 56 acting against the outer shell 14 through the spherical aligners 48' and 50. Locating rings 55 are provided in grooves formed in the mating surfaces of adjacent engine body sections for fixing the sections against relative radial displacement. The locating rings 55 may be conventional locating rings fitted into grooves in the mating surfaces of such rings may be machined integrally in the mating surfaces. No other fasteners however are used nor required to maintain the various body sections in axially assembled relationship. Minor leakage of working gas between the mating surfaces of the various body sections is easily tolerated since the escaping gas flows into the buffer space enclosed by the outer shell 14 and not into the atmosphere, particularly since the system is provided with a pumping arrangement for repressurizing working gas drawn from the low pressure buffer space and replenishing the displacer chamber with pressurized working gas.

Figure 4A:
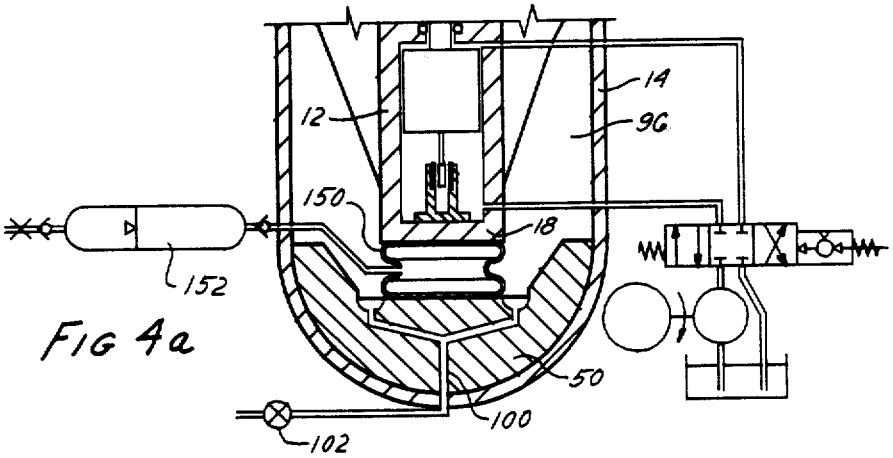
FIG. 4*a* is a fragmentary longitudinal section of a thermal machine showing use of a hydraulic pressure accumulator connected to a bellows for compressively pre-loading the machine body.
Figure 4B:
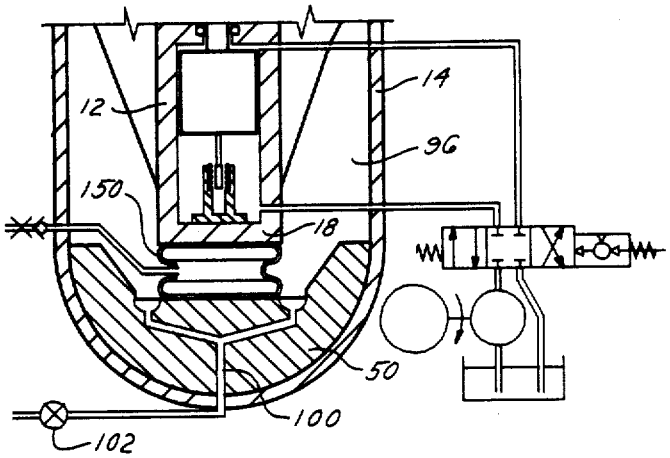
FIG. 4*b* is a fragmentary longitudinal section of a thermal machine showing use of a bellows filled with pressurized compressible fluid for compressively preloading the machine body.
Figure 4C:
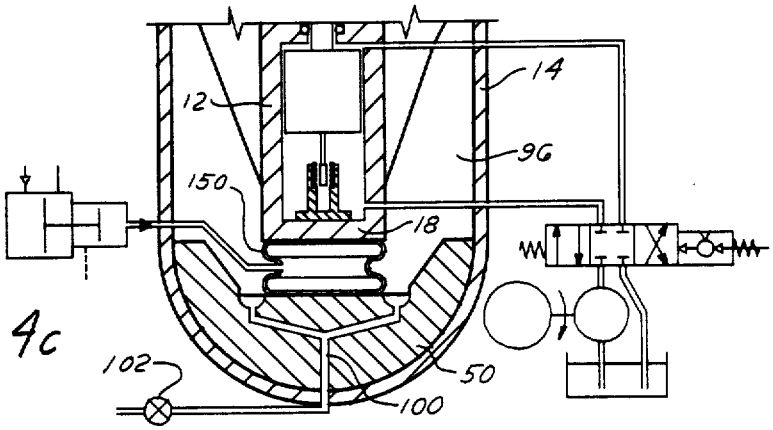
FIG. 4*c* is a partial longitudinal section of a thermal machine showing use of a pressure compensator unit charging a bellows for compressively pre-loading the machine body.

The pre-loading spring 56 is shown in both FIGS. 1 and 2 as a mechanical spring, specifically as a single or stacked Belleville washer arrangement. The pre-loading spring 56 may however take many other forms. For example, in FIGS. 4a through 4c, the Belleville spring 56 has been replaced by a bellows 150 interposed between the lower end 18 of a thermal machine 12 and lower spherical aligner 50 and expandable along the main engine axis. The bellows 150 may be pressurized by any suitable means, including the use of a hydraulic fluid accumulator 152 as a pressure source in FIG. 4a, by a charge of compressible liquid such as a compressible silicone based oil or by gas charge maintained at a sufficient pressure as in FIG. 4b or by use of an air-hydraulic intensifier connected to the bellows as in FIG. 4c, so as to provide the axial spring loading of the engine body assembly and thus maintain the outer shell 14 in tension while the thermal machine 12 is maintained in axial compression. FIGS. 4a–4c show only the lower or work input portion of a thermal machine configured as a refrigerator with a work piston driven by a hydraulic input similar to the refrigerator of FIG. 3.

Figure 5C:
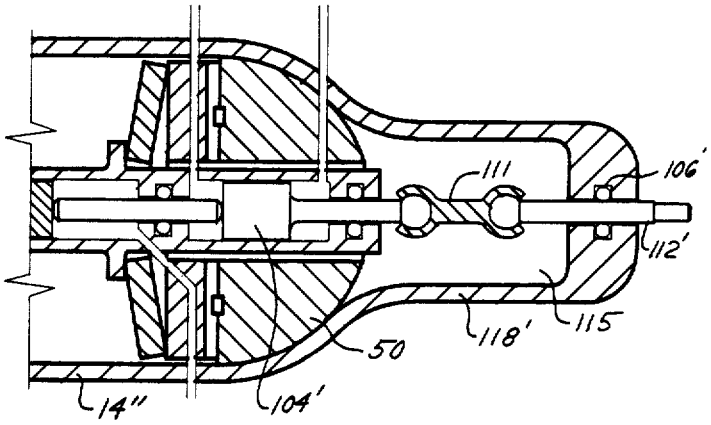
FIG. 5*c* is a fragmentary longitudinal section showing the sealing of an axially reciprocating output shaft.
Figure 5A:
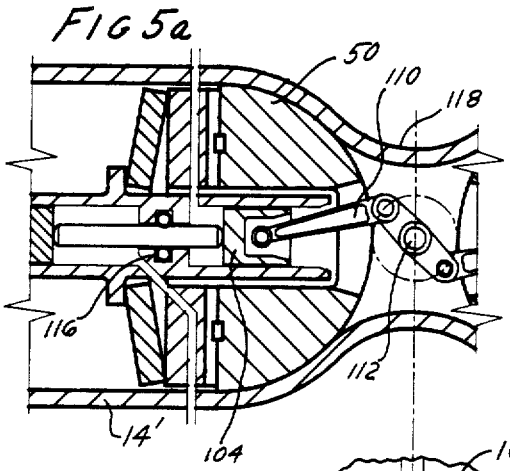
FIG. 5*a* is a fragmentary longitudinal section showing a mechanical crankshaft output arrangement for an engine enclosed in an outer shell according to this invention.

FIG. 5a illustrates a thermal machine comprising two engines each having a compound work piston 104 and driving a common crank shaft 112. The two engines are mounted end-to-end in axially opposing relationship within a single modified outer shell 14', each engine being provided with an upper and lower spherical aligner of which only the adjacent lower aligners 50 are shown. A constricted shell region 118 between the lower spherical aligners 50 of the two engines connects the outer shell portions enveloping each of the two engines. The constricted shell region 118 defines a crankcase within which is disposed a crank-shaft arrangement including drive shaft 112 mounted at right angles to the longitudinal axis of the two engines and driven by the opposing work pistons 104 (only one piston being shown in FIG. 5a) through crank-arms 110. The drive shaft 112, as seen in FIG. 5b extends through the wall of the crank case 118 to the exterior of the shell 14' for coupling to an engine load. The particular engine and crank case arrangement in FIG. 5a is shown to illustrate the mechanical output shaft 112 extending through a low pressure shaft seal 106 in the wall of the shell 14' in the area of crank case 118 as shown in FIG. 5b. The crank case space communicates with the buffer spaces defined by the outer shell 14' around each of the two engines and is filled with working gas at the same low pressure as are these buffer spaces, i.e. at atmospheric or preferably slightly above atmospheric pressure. The pressure differential across the seal 106 can thus be kept very low, which greatly facilitates the sealing of the mechanical output shaft to the outer shell 14' as compared to the high pressure seals normally required in similar engines where no working gas filled low pressure buffer space is defined by an outer envelope 14'. It will be understood that while the examples shown in FIGS. 5a–5d show engine output shafts, the same low pressure shaft sealing principle is applicable to mechanical work input shafts for refrigerator machines.

FIG. 5c illustrates the same principle of a low pressure shaft seal 106' for sealing a linearly reciprocating mechanical output shaft 112' extending through a bottlenose extension 118' of an outer shell 14" enclosing a thermal machine having a compound work piston 104' connected to the output shaft 112' by means of a universal joint 111. Again, only a low pressure dynamic seal 106' is required for sealing the internal space 115 in communication with a buffer space defined by the outer shell 14" and filled with working gas at relatively low pressure.

Figure 5D:
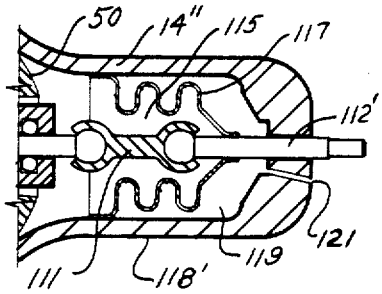
FIG. 5*d* shows a bellows seal for a linearly reciprocating output shaft.
Figure 5B:
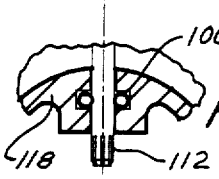
FIG. 5*b* is a fragmentary longitudinal section showing the seal between the output shaft and the outer shell in FIG. 5*a*.

FIG. 5d shows an arrangement similar to that of FIG. 5c where the dynamic seal 106' of FIG. 5c has been replaced by a bellows seal 117 attached between the wall of the outer shell 14" and the output shaft 112' for sealing the working gas filled space 115. The space 119 on the opposite side of the bellows is vented to the outer atmosphere by an opening 121 in the outer shell 14". The low pressure differential imposed across the bellows seal 117 makes for greater reliability and prolonged service life of the bellows structure.

Figure 6:
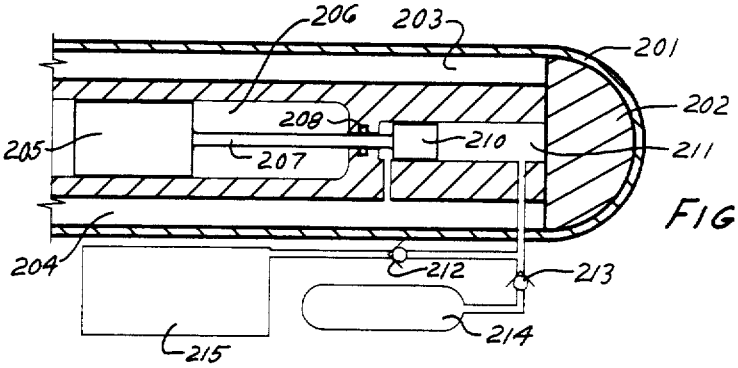
FIG. 6 shows in fragmentary longitudinal section the work output end of an engine constructed as a gas compressor for compressing a gas similar to the working gas used by the engine.

FIG. 6 shows the work output end of a thermal engine particularly adapted for compressing a gas which is the same as the working gas in the engine. The engine is shown only in part, being of conventional construction as to portions not shown, including the usual displacer arrangement. The work piston 205 of the engine works against a gas spring 206 and is connected, by means of a linkage rod 207 extending through seal 208 in the bottom wall of the work piston cylinder to a compressor piston 210 reciprocating in compressor cylinder 211. The engine is enclosed within an outer shell 201 constructed in the manner already described, including a lower spherical aligner 202, it being understood that the engine includes an opposite upper spherical aligner at the thermal end not shown in the drawing. The outer shell 201 defines a buffer space 204 about the engine body 216 filled at low pressure with working gas used in the displacer chamber of the engine. This engine arrangement may advantageously be used as a compressor for compressing a gas produced at low pressure in an external gas generator 215 which generates gas similar to the working gas used in the engine and filling the buffer space 204. The gas generator 215 is connected through check valve 212 to the bottom of the compressor cylinder 211 and is also connected through check valve 213 to a high pressure gas storage tank 214. The top of the compressor cylinder 211 is vented through opening 209 to the engine buffer space 204. As the compressor piston 210 is reciprocated by the work piston 205, low pressure gas from the generator 215 is drawn into and compressed in cylinder 211 for charging the storage tank 214. The advantage of this arrangement is that no sealing is required between the compressor cylinder 211 and the atmosphere because of the intervening buffer space 204. Any leakage of compressed gas into the buffer space is harmless since the gas being compressed is the same as the working gas of the engine and no contamination of the same takes place. Likewise, no contamination of the gas compressed in cylinder 211 occurs since any leakage into the cylinder 211 is of similar gas from the buffer space and therefore it is possible to maintain a high degree of purity of the compressed gas.

FIG. 3 shows a thermal machine 310 having a machine body 312 enclosed in a hermetically sealed outer shell 314 and maintained in axial compression between an upper spherical aligner 48 and a lower spherical aligner 50 in a manner analogous to that of engine 12 in FIG. 1. Like elements in FIGS. 1 and 3 bear like numbering. The shell 314 of FIG. 3 is shown as a single shell without the outer filament winding 52 of FIG. 1. The machine 310 is configured as a refrigerator having a cold finger or refrigerator coil 326, such as an ammonia filled tube connected to cooling coil 328 wound around the cold end of the displacer chamber 24 in the cold head section 320 of the engine body 312.

The piston element 36b of the compound work piston 36 in FIG. 3 is driven hydraulically by a hydraulic work input circuit comprising upper and lower hydraulic lines 315 and 317 respectively connected to the hydraulic cylinder 40 on opposite sides of the hydraulic piston element 36b, a four-way hydraulic control valve 319, motor driven hydraulic pump 321 and hydraulic fluid reservoir 323. The four-way valve 319 is controlled by an output control signal derived from engine controller 60 so as to control the direction of hydraulic fluid flow through the lines 315, 317 as well as the instantaneous volume of such fluid flow to thereby maintain continuous positive control over the motion of the compound work piston 36. The engine body 312 in FIG. 3 is shown as consisting of two axial sections namely cold head section 320 retained to the remainder 322 of the body 312. The two engine body sections are maintained in axial compression to maintain a gas tight seal at their mating surfaces 321 by means of a static seal 58.

Further distinctions between the FIG. 3 thermal machine and the embodiment of FIG. 1 include provision of an external motor driven gas pump 327 which draws working gas from the low pressure upper buffer space 76 defined in the engine body through conduit 329 and associated check valve, and compresses the gas for storage in high pressure annular storage space 72 through conduit 331. The external gas pump 327 and associated conduits 329, 331 replace part of the pumping arrangement associated with pump cylinder 80 in FIG. 1, and specifically eliminating the gas passages 86 and 88 in FIG. 1. The FIG. 3 machine retains passages 84 and 90 which cooperate with pump piston 80 for drawing low pressure working gas from the upper buffer space 76, and compressing the same into the displacer chamber 24 through conduit 90. The gas space 338 below piston element 36a has been opened to the upper buffer space by means of passage 339 so that pressure in space 338 is equalized with working gas pressure in the upper buffer space 76, as well as with lower buffer space 96a through pressure equalizing check valve 98.

Figure 7:
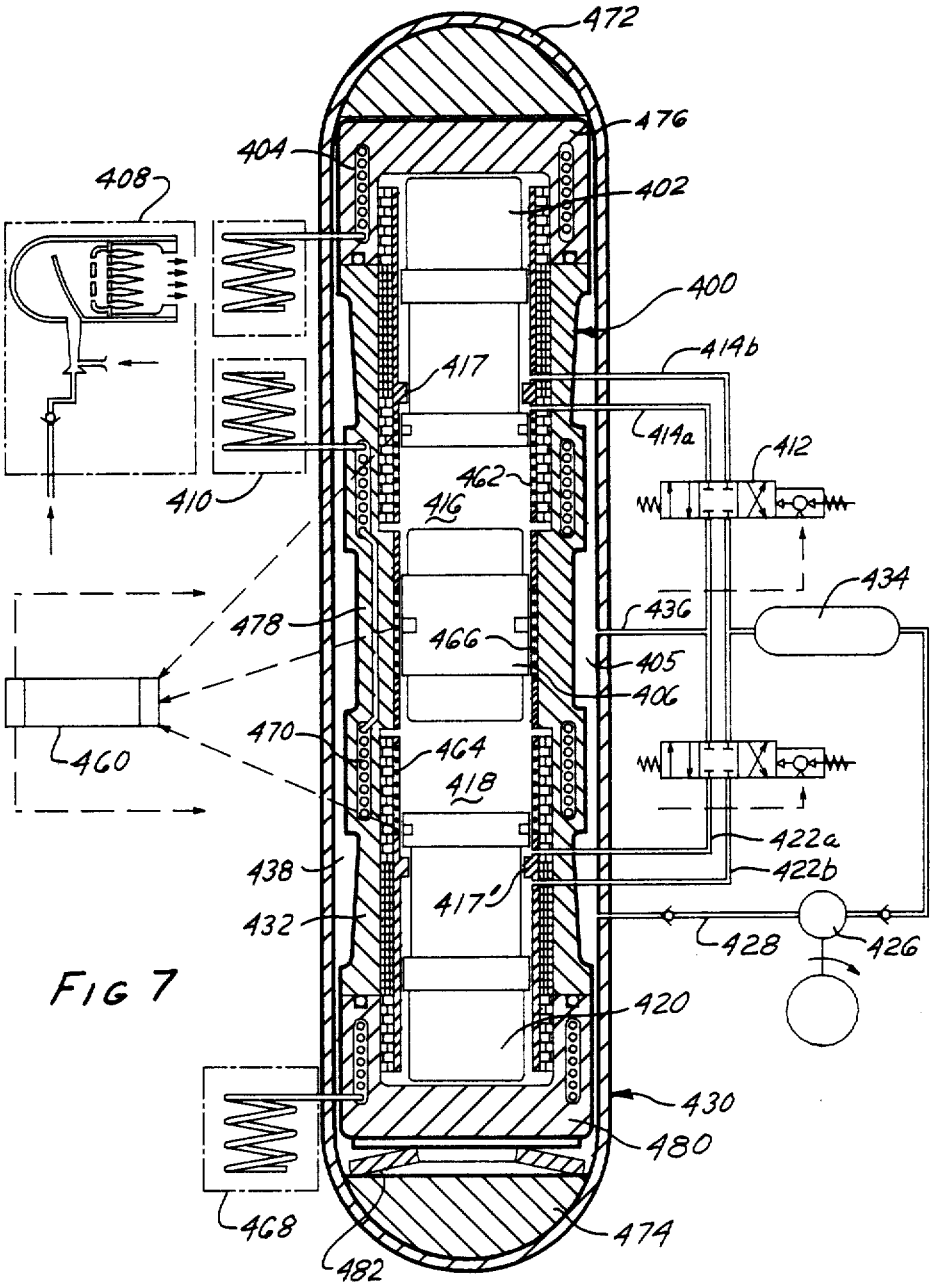
FIG. 7 is a longitudinal section of a thermal machine combining a Stirling cycle engine driving a Stirling cycle refrigerator enclosed in a common outer shell.

Turning now to FIG. 7, a sealed outer shell 430 is shown enveloping a Stirling cycle engine/refrigerator combination thermal machine 400 having a common free work piston 406. The upper portion of the thermal machine 400 is an engine having a displacer 402, a heating coil 404 powered by an external engine burner system 408, and a cooling coil system 410. The displacer 402 is reciprocated by means of a pneumatic control system including four-way pneumatic servo-valve 412 and pneumatic control lines 414a and 414b which apply a controlled pressure differential on either side of dynamic seal 417, as has explained in connection with similar pneumatic displacer control systems in FIGS. 1–3. The cyclic variations in working fluid pressure in upper displacer chamber 416 drive the work piston 406 which in turn induces corresponding cyclic variations in working gas pressure in a lower displacer chamber 418, thereby producing cyclic variations in working gas temperature in the lower displacer chamber. The machine further comprises a refrigerating coil 468, and a heat sinking coil 470 on the "hot" side of the refrigerator displacer chamber 418 and which is connected to the cooling coil 410 of the engine side of the machine. A second displacer 420 associated with the lower refrigerator section of the machine 400 is similarly pneumatically driven by a controlled pressure differential across seal 417' applied through pneumatic control lines **422*a* and 422*b* and a second four-way pneumatic control servo-valve 424. Pneumatic pressure is supplied by a motor driven pneumatic pump 426 external to the outer shell 430 enclosing the thermal machine and connected through conduit 428 for drawing working gas from the low pressure buffer space 405 defined between the machine body 432 and the wall of outer shell 430. The working gas compressed by pump 426 is stored at high pressure in pneumatic supply tank 434 which feeds the supply control lines 414*b* and 422*b* through the corresponding control servo-valves 412 and 424. The pair of return pneumatic control lines 414*a* and 422*a* are connected through their corresponding control valves 412 and 424 and through common return line 436 to the low pressure working gas filled buffer space 438. Each of the pneumatic control valves 412 and 424 controls the direction and magnitude of the pneumatic pressure differential across the two lines associated with each control servo-valve so as to maintain positive and independent control over the motion of each displacer 402, 420. The relative phase between the two displacers and the free work piston 406 is controlled by engine controller 460 which receives control inputs from position sensors 462, 464, and 466 which provide position information to the engine controller for the upper displacer, lower displacer and work piston respectively. The engine controller derives output control signals based on said input information which output signals are connected for controlling the two four-way servo-valves 412, 424**, thus completing the servo-control loop.

In the FIG. 7 example the combined engine/refrigerator is enclosed in a single outer shell 430 having a cylindrical cross-section and closed at each end by hemispherical end sections. Upper and lower spherical aligners 472, 474 respectively are provided between the shell end sections and the upper and lower ends of the machine body 432 so as to maintain the machine body in axial compression, thereby maintaining various machine body sections such as an upper hot head section 476, intermediate body section 478 and lower cold end section 480 in axially compressed, gas sealing relationship as has been earlier described in connection with the various examples of FIGS. 1–3. The axially compressive force is provided by pre-loading spring 482 compressed between the lower end of the engine body and the lower hemispherical aligner 474, thus also maintaining the outer shell 430 in tension between its two ends.

A combination engine/refrigerator such as in FIG. 7 may be advantageously powered by a first source of waste heat for cooling a second source of waste heat, as for example in electronic systems or computers which generate large amounts of heat, the first heat source being selected to be greater than the second heat source.

Figure 8A:
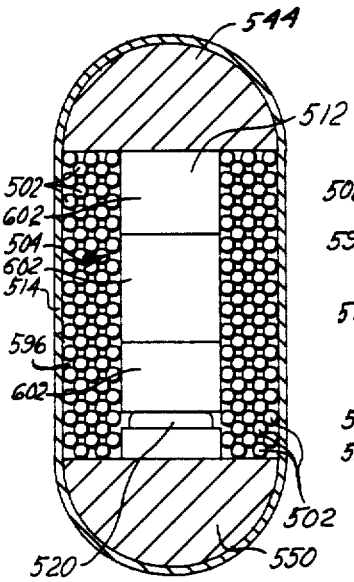
FIG. 8*a* is a longitudinal section of a thermal machine illustrating a first type of shock wave diffuser.
Figure 8B:
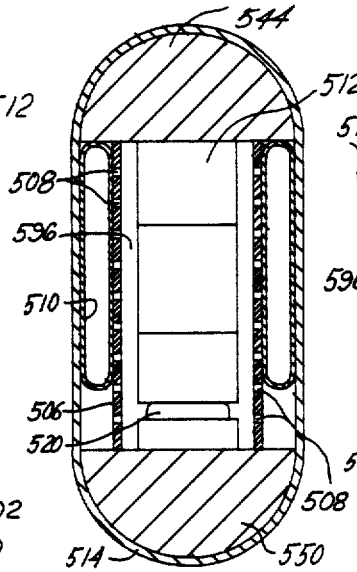
FIG. 8*b* is a longitudinal section of a thermal machine illustrating a second type of shock wave diffuser and vacuum insulating elements.
Figure 8C:
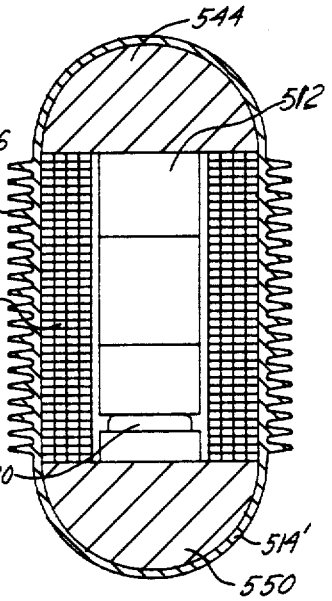
FIG. 8*c* is a longitudinal section of a thermal machine illustrating a third type of shock wave diffuser.

The outer shell 14 is desirably constructed of a high tensile strength material such as steel capable of substantially containing or rendering harmless both the shock wave and fragments projected in the event of explosive failure of the machine body 12. However, the containment capability of the outer shell may be improved by providing diffuser elements between the machine body 12 and the outer shell 14 for diffusing the high pressure front or shock wave traveling from the machine body towards the outer shell and for aiding in the containment of machine body fragments to thus at least partially shield the outer shell from damage caused by impact of such fragments. The diffuser elements may take a variety of forms, some of which are illustrated in FIGS. 8*a* through 8*c*. FIG. 8*a* shows a thermal machine body 512 held between upper and lower spherical aligners 544, 550 respectively and compressively loaded along the main longitudinal axis of the machine body 512 within an outer shell 514 which defines a buffer space 596 between the machine body 512 and the shell 514. This buffer space is substantially filled with relatively small spheres 502, either hollow or solid, of any suitable material, such as steel, ceramic, composite or others. The individual spheres 502 are closely packed together and are preferably sintered, fused, or otherwise attached one to the other so as to form a cohesive diffuser matrix structure 504 within the buffer space 596 surrounding the machine body between its two ends. The cohesive wave front of a shock wave traveling through the diffuser matrix 504 is broken up and dispersed both over time and over a larger surface area of the outer shell 514 than would be the case without such diffuser element, thus enhancing the containment capability of the outer shell. The diffusion matrix 504 also presents a physical barrier through which any machine body fragments explosively propelled must travel before reaching the containment shell 514, which barrier is therefore effective in at least slowing down or entirely stopping such fragments before impacting against the shell 514. The spherical elements 502 may be, for example, hollow metallic spherical shells which collapse and deform to absorb the impact of flying fragments while maintaining a diffusion matrix structure about the machine body 512.

FIG. 8*b* shows an alternate diffusion element 506 consisting of a cylindrical tube of relatively heavy wall thickness and perforated by numerous relatively small orifices 508 to form a cylindrical screen about the machine body 512. The diffusion screen 506 again serves to disperse a shock wave traveling outwardly from the machine body 512 and to also stop or slow down flying fragments directed towards the outer shell 514. The holes 508 are small enough so that only very small flying fragments can pass through unhindered, and such small fragments are readily contained by the outer shell 514 itself. The thermal machine of FIG. 8*b* also illustrates the use of a toroidal evacuated insulating vessel 510 which may be a glass vessel preferably having internally silvered wall surfaces. Such glass insulator forms a lightweight but highly effective insulator about the machine body 512, and in particular about the thermal end of the machine body, for the purpose of minimizing the amount of sokid insulating layers needed around the thermal end for very high temperature machine operating cycles. Highly efficient insulation at the thermal end allows a reduction in machine body cross-section at that end to facilitate construction of a machine body of substantially uniform cross-section, e.g. a cylinder. A machine body of uniform cross section minimizes or eliminates compound stresses on the machine body resulting from thermal effects and distortions caused by the high pressure of working fluids contained within the machine body. Elimination of compound stresses permits high pressure engine operation because simple axial and radial stresses are more readily dealt with by appropriate machine body design and/or by pre-loading of the machine body components as for example by compressively loading the machine body between the two ends by means of the outer shell 510 which is thus held in substantially pure tension, all has already been explained above. The relatively fragile vacuum insulator 510 is protected against damage from external influences by the outer shell 514.

FIG. 8*c* shows a thermal machine arrangement which differs from that of FIG. 8*a* in that the outer shell 514' is provided with an integral heat radiator 516 which helps in dissipating heat generated by the thermal machine within the outer shell 514'. In addition, the system of FIG. 8*c* shows a third type of diffuser element 518 consisting of multiple layers of mesh such as wire mesh wound about the machine body 512 and partially or completely filling the buffer volume 596 defined within the outer shell 514'. The mesh material again serves to diffuse the high pressure front of a shock wave and also as a physical shield against flying fragments between the machine body and outer shell.

All of the systems shown in FIGS. 8*a*–8*c* show the machine body 512 compressively pre-loaded between the spherical aligners 544 and 550 by means of a hydraulically pressurized piston 520 as a possible alternative to the earlier described mechanical, pneumatic or hydraulic pre-loading systems.

In cases where the machine body 512 is composed of adjacent axial machine body sections 602, three such sections being shown in FIG. 8*a* as comprising the machine body 512, the sections 602 are compressively loaded between the spherical aligners so as to hold the three sections 602 in operative axially assembled relationship. It is desirable however to assure as far as possible that the various body sections 602 are in radially aligned relationship i.e. one section is not radially shifted in relation to an adjacent body section, while at the same time providing a gas and/or fluid-tight pressure seal between adjacent body sections 602.

Figure 9B:
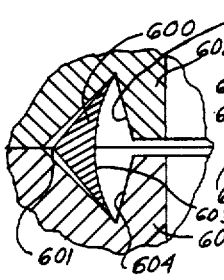
FIGS. 9*a* and 9*b* show a Delta ring used to seal and align axially adjacent sections of the thermal machine body.
Figure 9A:
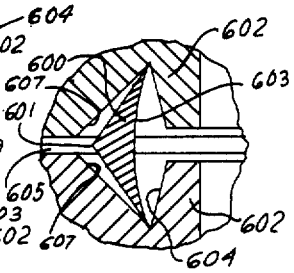

FIGS. 9*a* and 9*b* illustrate the use of a Delta ring, of a known type, interposed between adjacent body sections 602 for simultaneously assuring radial alignment and a pressure tight seal between adjacent body sections 602. The Delta ring has a cross-section as shown in FIG. 9*a*, the apex 601 of the generally triangular cross-section facing radially outwardly in relation to the machine body 512, while the concave inner ring surface 603 faces inwardly towards the pressurized bore of the machine body. The ring is fitted within grooves 604 of triangular cross-section defined in the axial ends of the adjacent body sections 602. FIG. 9a shows two body sections 602 slightly separated by a gap 605 as may occur during engine operation, while in FIG. 9*b* the two sections 602 are shown pushed together and the gap 605 closed. The Delta ring 600 deforms resiliently as the body sections 602 move between the conditions of FIGS. 9*a* and 9*b* to maintain a positive pressure seal between the two sections, the ring 600 at the same time holding the two body sections 602 in mutual radial alignment.

Figure 10:
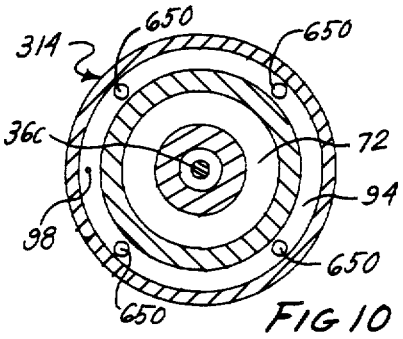
FIG. 10 is a cross section taken along line 10—10 in FIG. 3.

FIG. 10 is a cross-section of the thermal machine taken along line 10—10 in FIG. 3 showing in plan view the bulkhead 94 between the machine body 312 and the outer shell 314. The bulkhead 94 is preferably of relatively thick material sufficient to resist substantial pressure differentials between the two sides of the bulkhead, or for helping support the machine body 312 in centered relationship within the outer shell 314.

Figure 11:
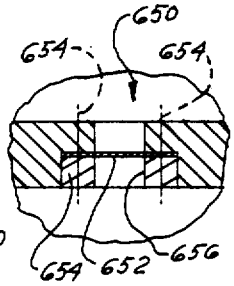
FIG. 11 is a fragmentary cross section of a burst disk such as may be used in the bulkhead of FIG. 10.

A number of rupturable elements 650 may be provided in the bulkhead partition 94 so as to yield at a predetermined pressure differential across the bulkhead and thereby admit gas from the upper compartment 96 into the lower compartment 96*a* within the outer shell in the event of explosive release of highly pressurized working gas in the displacer chamber 24. The elemtns 650 may of course likewise yield in the event that excessive pressure build up occurs in the lower compartment 96*a*. In either case, rupture of the elements 650 provides additional expansion volume into which the pressurized gas may expand and thereby relieve the pressure on the outer shell 14, to aid the outer shell in the containment of pressurized gases released therein as may occur in the event of machine body failure. The elements 650 may take the form of burst discs 652 such as shown in FIG. 11, each disc mounted to the bulkhead 94 by means of a retainer ring 654 secured to the bulkhead by fasteners 656 suggested by fastener center lines only. Each burst disc 652 normally closes an expansion hole 656 in the bulkhead 94 and opens the hole by structurally failing at a predetermined pressure differential.

Figure 12:
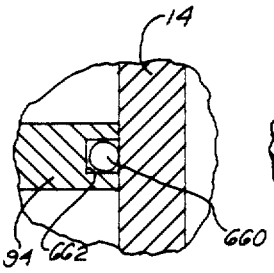
FIG. 12 illustrates a dynamic seal between the bulkhead and the outer shell.

In some cases, it may be desirable to mount the bulkhead 94 so as to permit limited axial displacement of the bulkhead relative to the outer shell 14 while maintaining a gas tight seal between the bulkhead and outer shell. Such limited bulkhead displacement may be advantageous in accommodating settling of the machine body sections caused by compressive axial pre-loading of the machine body, or by thermal expansion and contraction. Such limited bulkhead displacement may be accommodated by providing a dynamic seal between the radially outer edge of the bulkhead 94 and the inner surface of the outer shell 14 as shown in the fragmentary cross-sectional view of FIG. 12. The dynamic seal is shown to consist of a seal ring 660 fitted within a circumferential seal groove 662 in the bulkhead edge, such that the ring 660 makes sliding sealing contact with the outer shell 14 to allow longitudinal displacement of the bulkhead while maintaining seal integrity. Other dynamic seal constructions may be found suitable in lieu of the one shown.

Figure 13:
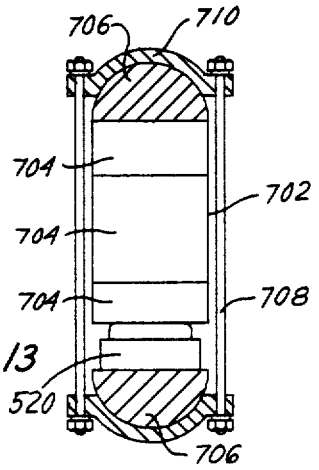
FIG. 13 illustrates an alternate thermal machine body axial pre-loading arrangement employing tie rods instead of a closed outer shell.

FIG. 13 shows a thermal machine 700 wherein a machine body 702 consisting of a number of axial body sections 704 is held in axial compressive loading between upper and lower spherical aligners 706 which are interconnected by two or more tie-rods 708. The tie-rods hold end pieces 710, each including a spherical aligner 706, in fixed spaced relationship while a hydraulic piston 520 or equivalent system applies loading force between one of the spherical aligners 706 and one end of the machine body 702 so as to urge together the body sections 704 into axially assembled operative relationship. The force applied by the pre-loading piston 520 exceeds the internal pressure of the working fluid within the machine body 702 so as to hold the body sections 704 against the expansive force of the pressurized fluid. The system of FIG. 13 retains the advantages ennumerated in connection with the outer shell system of FIGS. 1–8c as far as simplifying the construction and assembly of the thermal machine body 702 by making possible the elimination of bolt and flange assemblies between the body sections 704 previously used to hold together such engine bodies, while relinquishing the protective benefits of a closed outer shell envelope. A system such as that of FIG. 13 may be found useful where the machine is installed in secluded, unpopulated areas or where access to the immediate vicinity of the machine is restricted so as to minimize the risk of injury to persons in the event of catastrophic failure of the pressurized machine body.

Particular embodiments of the various improvements disclosed herein have been described and illustrated for purposes of clarity and by way of example only, it being understood that various changes, substitutions and modifications to the described embodiments will become apparent to those possessed of ordinary skill in the art without departing from the spirit and scope of the claimed improvements which are defined only by the following claims.

What is claimed is:

1. In a thermal machine of the type including a machine body having a main axis extending between a thermal end and a work end, a working fluid at relatively high pressure in a working fluid chamber defined in said body and a displacer element reciprocable within said chamber for subjecting the fluid to a thermodynamic cycle in cooperation with a reciprocable work piston, the improvement comprising outer shell means enclosing said machine body for maintaining a substantially sealed atmosphere about said machine body, and diffuser means arranged between said machine body and said outer shell means for diffusing a shock wave traveling towards the outer shell means resulting from explosive failure of said machine body and for shielding said outer shell means against fragments projected upon such failure.

2. The machine of claim 1 wherein said diffuser means comprises a plurality of layers of open weave mesh material.

3. The machine of claim 1 wherein said diffuser means comprises one or more cylinders arranged concentrically about said machine body, said cylinders being perforated for diffusing an explosive wave front traveling from said machine body towards said outer shell means.

4. The machine body of claim 1 wherein said diffuser means comprises one or more layers consisting of packed together spheres.

5. The machine body of claim 1 wherein said sealed atmosphere is substantially oxygen free.

6. In a thermal machine of the type including a machine body having a main axis extending between a thermal end and a work end, a working fluid at relatively high pressure in a working fluid chamber defined in said body and a displacer element reciprocable within said chamber for subjecting the fluid to a thermodynamic cycle in cooperation with a reciprocable work piston, the improvement comprising outer shell means enclosing said machine body for maintaining a substantially oxygen free atmosphere about said machine body.

7. The thermal machine of claim 6 wherein said substantially oxygen free atmosphere is of a composition different from said working fluid.

8. In a thermal machine of the type including a machine body having a main axis extending between a thermal end and a work end, a working fluid at relatively high pressure in a working fluid chamber defined in said body and a displacer element reciprocable within said chamber for subjecting the fluid to a thermodynamic cycle in cooperation with a reciprocable work piston, mechanical linkage means passing through said machine body at said work end for delivering a work output, and dynamic seal means between said linkage means and said machine body for sealing said machine body against leakage of internal pressurized gas through the linkage means passage the improvement comprising:

outer shell means enclosing said machine body for maintaining a substantially sealed atmosphere about said machine body, a baffle means partitioning said shell means transversely to said machine body so as to define a first compartment for maintaining a relatively low pressure atmosphere about said thermal end and a second compartment for maintaining a higher pressure atmosphere about said work end so as to reduce the rate of leakage of said internal pressurized gas past said seal means.

9. The thermal machine of claim 8 wherein said first and second outer shell compartments contain different gases.

10. The thermal machine of claim 8 further comprising pressure relief means in said baffle means adapted to yield in response to a rise in pressure in said first compartment above a predetermined level so as to admit gas from said first to said second compartment thereby to relieve pressure in said first compartment.

11. the thermal machine of claim 10 wherein said pressure relief means comprise burst elements adapted to yield by rupturing in response to said pressure rise.

12. In a thermal machine of the type including a machine body having a main axis extending between a thermal end and a work end, a working fluid at relatively high pressure in a working fluid chamber defined in said body and a displacer element reciprocable within said chamber for subjecting the fluid to a thermodynamic cycle in cooperation with a reciprocable work piston, the improvement comprising:

outer shell means enclosing said machine body for maintaining a substantially sealed atmosphere about said machine body, baffle means partitioning said shell means transversely to said machine body so as to define a first compartment about said thermal end and a second compartment about said work end, said first compartment being sealed from said second compartment, the second compartment receiving any fluid leakage from said work end thereby to preserve the atmosphere in said first compartment against contamination.

13. The thermal machine of claim 12 wherein said baffle means is movable longitudinally within said outer shell to accommodate thermal expansion of the machine body.

14. The thermal machine of claim 13 further comprising dynamic seal means between said baffle means and said outer shell for maintaining a substantially gas tight seal between said compartments.

15. The thermal machine of claim 12 wherein said first and second compartments contain different gases.

16. The thermal machine of claim 12 further comprising pressure relief means in said baffle means adapted to yield in response to a rise in pressure in said first compartment above a predetermined level so as to admit gas from said first to said second compartment thereby to relieve pressure in said first compartment.

17. The thermal machine of claim 16 wherein said pressure relief means comprise burst elements adapted to yield by rupturing in response to said pressure rise.

18. In a thermal machine of the type including a machine body having a main axis extending between a thermal end and a work end, a working fluid at relatively high pressure in a working fluid chamber defined in said body and a displacer element reciprocable within said chamber for subjecting the fluid to a thermodynamic cycle in cooperation with a reciprocable work piston, the improvement comprising outer shell means enclosing said machine body for maintaining a substantially sealed atmosphere about said machine body, and vacuum insulation means disposed about said thermal end and protected against damage by said outer shell.

19. The thermal machine of claim 18 wherein said vacuum insulation means comprise one or more evacuated glass vessels having heat reflecting surfaces.

20. In a thermal machine of the type including a machine body having a main axis extending between a thermal end and a work end, a working fluid at relatively high pressure in a working fluid chamber defined in said body and a displacer element reciprocable within said chamber for subjecting the fluid to a thermodynamic cycle in cooperation with a revciprocable work piston, the improvement comprising outer shell means enclosing said machine body for maintaining a substantially sealed atmosphere about said machine body, said machine body including a plurality of machine body sections held in axially assembled relationship by compressive force exerted thereon by said outer shell means, and locator seal means axially interposed between adjacent body sections simultaneously operative for radially aligning said body sections and pressure sealing said machine body against leakage therefrom into said outer shell.

21. The thermal machine of claim 20 wherein said locator seal means comprise delta ring means set into circular end grooves in each of said machine body sections.

22. In a thermal machine of the type including a machine body having a main axis extending between a thermal end and a work end, a working fluid at relatively high pressure in a working fluid chamber defined in said body and a displacer element reciprocable within said chamber for subjecting the fluid to a thermodynamic cycle in cooperation with a reciprocable work piston, the improvement comprising outer shell means enclosing said machine body for maintaining a substantially selaed atmosphere about said machine body, and normally open anti-detonation valve means in said outer shell means, said anti-detonation valve means closing in response to an explosive pressure rise in said outer shell thereby to seal against release of gases from said outer shell in the event of explosive failure of said machine body.

23. The thermal machine of claim 22 further comprising flammable gas igniter means associated with said anti-detonation valve means for igniting flammable gases leaking from said outer shell means through said normally open valve means, and flame arrestor means for arresting flame generated by ignition of such gases.

24. In a thermal machine of the type including a machine body having a main axis extending between a thermal end and a work end, a working fluid at relatively high pressure in a working fluid chamber defined in said body and a displacer element reciprocable within said chamber for subjecting the fluid to a thermodynamic cycle in cooperation with a reciprocable work piston, the improvement comprising outer shell means enclosing said machine body for maintaining a substantially sealed atmosphere about said machine body, said outer shell means being constructed, dimensioned and adapted for normally maintaining said machine body in axial compression between said ends, and filament means wound on said outer shell means for pre-stressing said outer shell against tensile forces imposed thereon by said machine body.

25. The thermal machine of claim 24 wherein said filament means are wound radially about said outer shell means so as to pre-load said outer shell means against internal forces acting radially outward on said outer shell means.

26. The thermal machine of claim 24 wherein said filament means are wound longitudinally between said ends of said outer shell means so as to pre-load said outer shell against internal forces tending to place said outer shell in axial tension between said ends.

27. A thermal machine having a machine body extending along a main axis between a thermal end associated with working fluid heater means and an opposite work end, said body including at least two axially joined body sections, and preloading means external to said machine body and acting on said ends to compressively pre-load said machine body between said ends for maintaining said body sections in axially assembled operative relationship.

28. The thermal machine of claim 27 wherein said pre-loading means include spherical aligner means acting on each of said machine body ends for maintaining said assembled body sections in axial alignment.

29. The thermal machine of claim 27 wherein said pre-loading means comprise a plurality of tie elements connecting body section aligner means fitted to each of said ends.

30. The thermal machine of claim 28 wherein said pre-loading means include a plurality of tie-rods extending between said spherical aligner means.

31. The thermal machine of claim 27 further comprising locator seal means axially interposed between axially adjacent ones of said body sections, said locator seal means simultaneously operative for radially aligning said body sections and pressure sealing said machine body against fluid leakage therefrom.

32. The thermal machine of claim 31 wherein said locator seal means comprise delta ring means set into circular end grooves in each of said adjacent machine body sections.

* * * * *

UNITED STATES PATENT AND TRADEMARK OFFICE

CERTIFICATE OF CORRECTION

PATENT NO. : 4,723,410

DATED : February 9, 1988

INVENTOR(S) : John L. Otters

It is certified that error appears in the above-identified patent and that said Letters Patent is hereby corrected as shown below:

The portion of the term of this patent subsequent to January 27, 2004 has been disclaimed.

Signed and Sealed this

Fifth Day of July, 1988

*Attest:*

DONALD J. QUIGG

*Attesting Officer*

*Commissioner of Patents and Trademarks*